US012280466B2

(12) United States Patent
Lee et al.

(10) Patent No.: US 12,280,466 B2
(45) Date of Patent: Apr. 22, 2025

(54) SUBSTRATE POLISHING APPARATUS, SUBSTRATE POLISHING SYSTEM INCLUDING THE SAME, AND SUBSTRATE POLISHING METHOD USING THE SAME

(71) Applicant: Samsung Electronics Co., Ltd., Suwon-si (KR)

(72) Inventors: Jaehyug Lee, Hwaseong-si (KR); Chae Lyoung Kim, Hwaseong-si (KR); Hoyoung Kim, Seongnam-si (KR); Seungjun Lee, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 412 days.

(21) Appl. No.: 17/825,449

(22) Filed: May 26, 2022

(65) Prior Publication Data

US 2023/0131040 A1 Apr. 27, 2023

(30) Foreign Application Priority Data

Oct. 22, 2021 (KR) ..... 10-2021-0142062

(51) Int. Cl.
*B24B 37/04* (2012.01)
*B24B 37/07* (2012.01)

(52) U.S. Cl.
CPC ..... *B24B 37/046* (2013.01); *B24B 37/042* (2013.01); *B24B 37/07* (2013.01)

(58) Field of Classification Search
CPC ..... B24B 37/005; B24B 37/04; B24B 37/042; B24B 37/046; B24B 37/10; B24B 37/105; B24B 37/34; B24B 49/10; B24B 7/228
See application file for complete search history.

(56) References Cited

U.S. PATENT DOCUMENTS 5,081,421 A * 1/1992 Miller ..... B24B 37/013 324/671
5,337,015 A * 8/1994 Lustig ..... G01D 5/2405 324/688
5,807,165 A 9/1998 Uzoh et al.
6,284,091 B1 9/2001 Wong
6,368,184 B1 * 4/2002 Beckage ..... B24B 37/013 451/550
6,620,336 B2 * 9/2003 Nakamura ..... B24B 37/20 438/692
6,722,942 B1 4/2004 Lansford et al.
(Continued)

FOREIGN PATENT DOCUMENTS

KR 2003-0049800 A 6/2003
KR 100564425 B1 3/2006

*Primary Examiner* — Joel D Crandall
(74) *Attorney, Agent, or Firm* — Harness, Dickey & Pierce, P.L.C.

(57) ABSTRACT

Disclosed are substrate polishing apparatuses, substrate polishing systems, and/or substrate polishing methods. The substrate polishing apparatus may include an electric field applying module, and a platen that rotates a polishing pad. The electric field applying module may include an inner electrode having a circular shape when viewed in plan. The platen may be on the inner electrode. A central axis of the inner electrode may be spaced apart from a central axis of the platen. The inner electrode may include a first electrode and a second electrode that may surround the first electrode and may have an annular shape.

20 Claims, 16 Drawing Sheets

(56) References Cited

U.S. PATENT DOCUMENTS

| | | | | |
|---|---|---|---|---|
| 6,935,929 | B2 | 8/2005 | Elledge | |
| 10,967,479 | B2 | 4/2021 | Liang et al. | |
| 2003/0068964 | A1* | 4/2003 | Akagami | B24B 37/04 451/287 |
| 2006/0163074 | A1* | 7/2006 | Manens | B23H 5/06 205/83 |
| 2007/0135024 | A1 | 6/2007 | Kobata et al. | |
| 2007/0187257 | A1* | 8/2007 | Noji | C25F 7/00 205/640 |
| 2014/0038413 | A1* | 2/2014 | Schmidt | H01L 21/304 438/692 |
| 2018/0361525 | A1 | 12/2018 | Chou et al. | |
| 2018/0361529 | A1* | 12/2018 | Liang | H01L 21/31053 |
| 2022/0193859 | A1* | 6/2022 | Wang | B24B 37/046 |

* cited by examiner

SUBSTRATE POLISHING APPARATUS, SUBSTRATE POLISHING SYSTEM INCLUDING THE SAME, AND SUBSTRATE POLISHING METHOD USING THE SAME

CROSS-REFERENCE TO RELATED APPLICATION

This U.S. nonprovisional application claims priority under 35 U.S.C. § 119 to Korean Patent Application No. 10-2021-0142062 filed on Oct. 22, 2021 in the Korean Intellectual Property Office, the disclosure of which is hereby incorporated by reference in its entirety.

BACKGROUND

Inventive concepts relate to a substrate polishing apparatus, a substrate polishing system including the same, and a substrate polishing method using the same, and more particularly, to a substrate polishing apparatus capable of separately controlling an electric field for each area, a substrate polishing system including the same, and a substrate polishing method using the same.

Various processes may be performed to fabricate a semiconductor device. For example, the semiconductor device may be fabricated by performing a photolithography process, an etching process, and a deposition process on a wafer. A surface of the wafer be planarized prior to each process. A polishing process may be executed on the wafer for planarization. The polishing process may be performed in a variety of ways. For example, a chemical mechanical polishing (CMP) process may be used to planarize the wafer.

SUMMARY

Some embodiments of inventive concepts provide a substrate polishing apparatus capable of separately controlling an electric field for each area, a substrate polishing system including the same, and a substrate polishing method using the same.

Some embodiments of inventive concepts provide a substrate polishing apparatus capable of separately controlling polishing of an edge region of a substrate, a substrate polishing system including the same, and a substrate polishing method using the same.

Some embodiments of inventive concepts provide a substrate polishing apparatus capable of easily controlling an electric field, a substrate polishing system including the same, and a substrate polishing method using the same.

Aspects of embodiments of inventive concepts are not limited to those mentioned above, and other aspect which have not been mentioned above will be clearly understood to those skilled in the art from the following description.

According to some embodiments of inventive concepts, a substrate polishing apparatus may include an electric field applying module; and a platen configured to rotate a polishing pad. The electric field applying module may include an inner electrode having a circular shape when viewed in plan. The platen may be on the inner electrode. A central axis of the inner electrode may be spaced apart from a central axis of the platen. The inner electrode may include a first electrode and a second electrode. The second electrode may surround the first electrode and may have an annular shape.

According to some embodiments of inventive concepts, a substrate polishing system may include a platen; a polishing pad on the platen; a slurry supply apparatus configured to supply slurry to a top surface of the polishing pad; a polishing head that supports a substrate; and a platen electrode coupled to the platen. The platen electrode may include a first electrode and a second electrode. The second electrode may surround the first electrode and may have an annular shape. Each of the first electrode and the second electrode may be divided into a plurality of electrodes that may be split along a circumferential direction of the platen.

According to some embodiments of inventive concepts, a substrate polishing method may include using a polishing head to place a substrate on a platen; allowing the substrate to contact a polishing pad, the polishing pad being configured to rotate; supplying slurry onto the polishing pad; and generating an electric field on the polishing pad. The generating the electric field on the polishing pad may include generating an electric field on a polishing location with which the substrate is in contact. The polishing location may be a portion of a top surface of the polishing pad. The polishing location may include a first polishing area and a second polishing area that surrounds the first polishing area. The generating the electric field on the polishing location may include applying a first voltage to a first electrode and a second voltage to a second electrode. The first electrode may be beneath the first polishing area. The second electrode may be beneath the second polishing area. The second voltage may be different from the first voltage.

Details of example embodiments are included in the description and drawings.

DETAILED DESCRIPTION OF EMBODIMENTS

Figure 1:
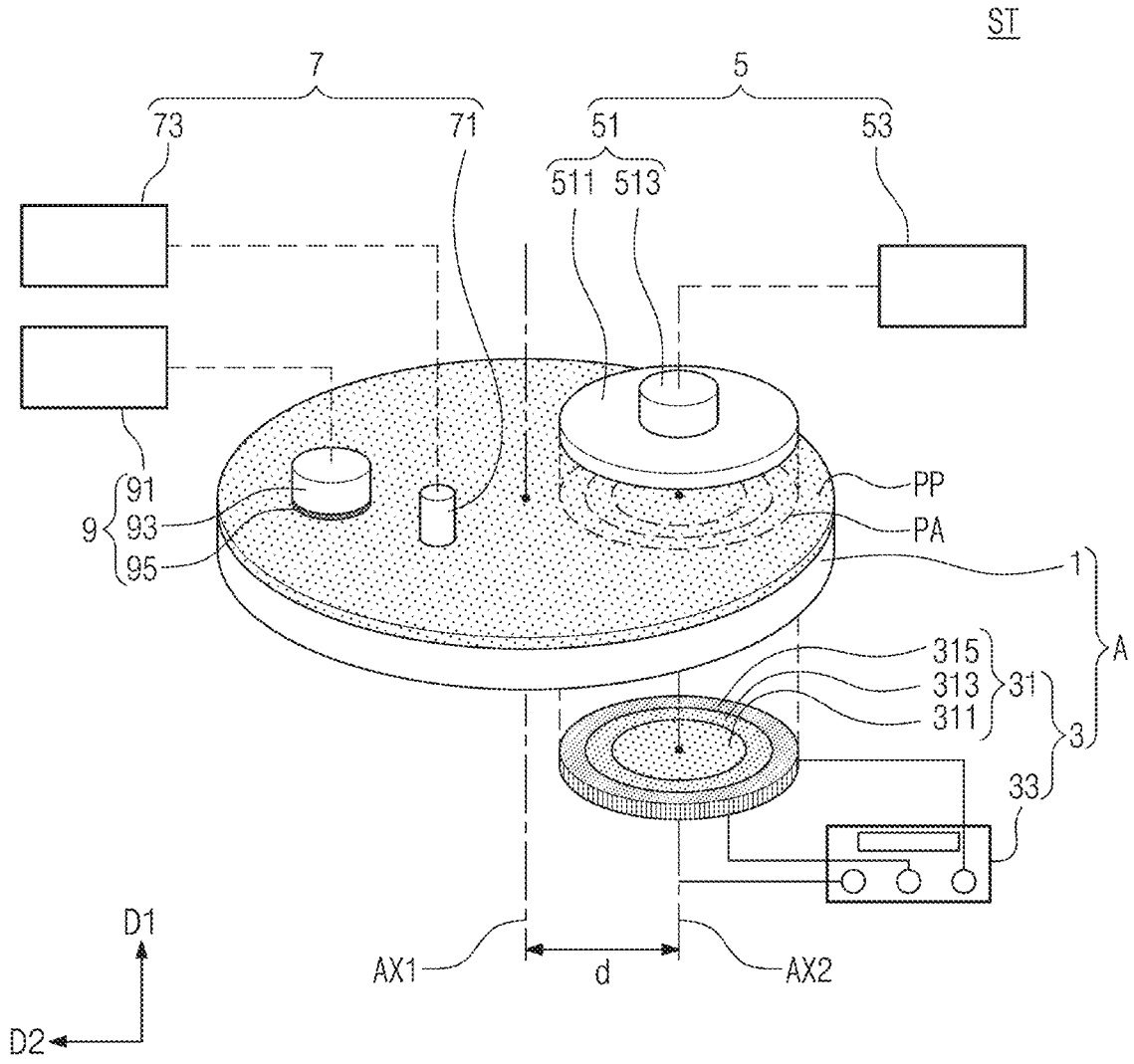
FIG. 1 illustrates a perspective view showing a substrate polishing system according to some embodiments of inventive concepts.

When the terms "about" or "substantially" are used in this specification in connection with a numerical value, it is intended that the associated numerical value includes a manufacturing or operational tolerance (e.g., ±10%) around the stated numerical value. Moreover, when the words "generally" and "substantially" are used in connection with geometric shapes, it is intended that precision of the geometric shape is not required but that latitude for the shape is within the scope of the disclosure. Further, regardless of whether numerical values or shapes are modified as "about" or "substantially," it will be understood that these values and shapes should be construed as including a manufacturing or operational tolerance (e.g., ±10%) around the stated numerical values or shapes.

The following will now describe some embodiments of inventive concepts with reference to the accompanying drawings. Like reference numerals may indicate like components throughout the description.

FIG. 1 illustrates a perspective view showing a substrate polishing system according to some embodiments of inventive concepts.

In this description below, symbol D1 may indicate a first direction, symbol D2 may indicate a second direction that intersects the first direction D1, and symbol D3 (see FIG. 3) may indicate a third direction that intersects each of the first and second directions D1 and D2. The first direction D1 may be called an upward direction, and a direction reverse to the first direction D1 may be called a downward direction. In addition, each of the second and third directions D2 and D3 may be called a horizontal direction.

Referring to FIG. 1, a substrate polishing system ST may be provided. The substrate polishing system ST may polish one surface of a substrate. A term "substrate" used in this description may denote a silicon (Si) wafer, but inventive concepts are not limited thereto. The substrate polishing system ST may include a substrate polishing apparatus A, a substrate support apparatus 5, a slurry supply apparatus 7, a conditioning apparatus 9, and a polishing pad PP.

The substrate polishing apparatus A may include a platen 1 and an electric field applying module 3. The electric field applying module 3 may also be referred to as an electric field applying apparatus 3. The platen 1 may support the polishing pad PP. For example, the polishing pad PP may be disposed on a top surface of the platen 1. The platen 1 may have a circular shape when viewed in plan. For example, the platen 1 may have a disk shape. The platen 1 may have a diameter of about 700 mm to about 900 mm. For example, the diameter of the platen 1 may be about 800 mm or about 750 mm. The platen 1 may rotate about a central axis AX1 parallel to the first direction D1. The platen 1 may allow the polishing pad PP to rotate. For example, when the platen 1 rotates about the central axis AX1, the polishing pad PP disposed on the platen 1 may also rotate about the central axis AX1. A drive mechanism may be separately provided to rotate the platen 1. For example, an electric motor or a hydraulic motor may be used for the rotation of the platen 1. The platen 1 will be further discussed in detail below.

The electric field applying module 3 may apply an electric field to the platen 1. For example, the electric field applying module 3 may form an electric field on a top surface (see 1*u* of FIG. 4) of the polishing pad PP by applying a voltage to an electrode. The electric field applying module 3 may include an inner electrode 31, a voltage applying device 33, and a voltage delivery member (see 35 of FIG. 2).

The inner electrode 31 may be disposed beneath the platen 1. For example, the platen 1 may be positioned on the inner electrode 31. For clarity of description, FIG. 1 depicts that the inner electrode 31 and the platen 1 are spaced apart from each other, but the inner electrode 31 may be disposed to allow its top surface to be close to a bottom surface (see 1*b* of FIG. 4) of the platen 1. A detailed description thereof will be further discussed below. The inner electrode 31 may have a circular shape when viewed in plan. For example, the inner electrode 31 may have a disk shape. The inner electrode 31 may have a diameter less than that of the platen 1. The diameter of the inner electrode 31 may be substantially the same as or similar to that of a polishing location PA which will be discussed below. For example, the diameter of the inner electrode 31 may range from about 250 mm to about 350 mm. For more detail, the diameter of the inner electrode 31 may be about 300 mm. The inner electrode 31 may have a central axis AX2 spaced apart from the central axis AX1 of the platen 1. The central axis AX2 of the inner electrode 31 may be spaced apart in a horizontal direction at a first distance d from the central axis AX1 of the platen 1. For example, the inner electrode 31 may be disposed below and eccentric to the platen 1. Therefore, when viewed in plan, nether the inner electrode 31 nor the platen 1 may form a concentric circle. The inner electrode 31 may receive a voltage from the voltage applying device 33. The inner electrode 31 may perform a translational motion. For example, the inner electrode 31 may perform a reciprocal motion in a horizontal direction. A drive mechanism may be separately provided to cause the inner electrode 31 to move in a horizontal direction. A detailed description thereof will be further discussed below. The inner electrode 31 may include a first electrode 311, a second electrode 313, and a third electrode 315.

The first electrode 311 may have a circular shape when viewed in plan. For example, the first electrode 311 may have a disk shape whose center is coincident with the central axis AX2 of the inner electrode 31. The second electrode 313 may surround the first electrode 311. For example, the second electrode 313 may have an annular shape that surrounds the first electrode 311. The third electrode 315 may surround the second electrode 313. For example, the third electrode 315 may have an annular shape that surrounds the second electrode 313. Each of the first, second, and third electrodes 311, 313, and 315 may include a conductive material. For example, each of the first, second, and third electrodes 311, 313, and 315 may include metal, but inventive concepts are not limited thereto. Each of the first, second, and third electrodes 311, 313, and 315 may be a mesh-type electrode. Alternatively, each of the first, second, and third electrodes 311, 313, and 315 may be a plate-type electrode. Inventive concepts, however, are not limited thereto, and each of the first, second, and third electrodes 311, 313, and 315 may be a group of a plurality of dot-type electrodes. A detailed description thereof will be further discussed below with reference to FIG. 10.

The voltage applying device 33 may apply a voltage to the inner electrode 31. For example, the voltage applying device 33 may apply different voltages to the first electrode 311, the second electrode 313, and the third electrode 315. The voltage applying device 33 may be disposed either close to or remote from the inner electrode 31. A detailed description of the electric field applying module 3 will be further discussed in detail with reference to FIG. 2.

The substrate support apparatus 5 may support and/or rotate a substrate. The substrate support apparatus 5 may include a polishing head 51 and a polishing head driver 53.

The polishing head 51 may rotate the substrate. The polishing head 51 may be disposed on a certain position on the polishing pad PP. For example, the polishing head 51 may place the substrate on a polishing location PA on the polishing pad PP. The substrate on the polishing location PA may be in contact with the top surface of the polishing pad PP. For example, the top surface of the polishing pad PP may have the polishing location PA at its region in contact with the substrate. The substrate may be polished on the polishing location PA. The polishing location PA may be a specific position stored in a controller. For example, information about the polishing location PA stored in a memory chip of the controller may be used such that the polishing head 51 may allow the substrate to rest on the polishing pad PP. The polishing location PA may have a circular shape. The polishing location PA may have a diameter of about 250 mm to about 350 mm. For example, the diameter of the polishing location PA may be about 300 mm. Inventive concepts, however, are not limited thereto. For example, when the polishing head 51 performs a translational motion on the polishing pad PP, the polishing location PA may not have a circular shape, but may have almost oval shape. The polishing location PA may be spaced apart from a center of the polishing pad PP. The inner electrode 31 may be disposed beneath the polishing location PA. For example, the inner electrode 31 may be disposed at a position to which the polishing location PA is vertically downwardly projected. Therefore, it may be regarded that the polishing location PA is positioned on the inner electrode 31.

The polishing head 51 may include a polishing head body 511 and a head support member 513. The substrate may be fixed to a bottom surface of the polishing head body 511. For example, the polishing head body 511 may use a vacuum pressure to adsorb the substrate on the bottom surface thereof. The polishing head body 511 may have a porous structure exposed on the bottom surface thereof. The head support member 513 may be coupled to the polishing head body 511. The head support member 513 may connect the polishing head body 511 to the polishing head driver 53.

The polishing head driver 53 may drive the polishing head 51 to move and/or rotate. For example, the polishing head driver 53 may place the polishing head 51 to the polishing pad PP. Alternatively, the polishing head driver 53 may rotate the polishing head 51 about an axis parallel to the first direction D1. This configuration may thus also rotate the substrate coupled to the bottom surface of the polishing head body 511. The polishing head driver 53 may include an actuator such as an electric motor or a hydraulic motor. In addition, the polishing head driver 53 may include a vacuum pump to provide the polishing head 51 with a vacuum pressure that adsorbs the substrate.

The slurry supply apparatus 7 may supply the polishing pad PP with slurry. The slurry supply apparatus 7 may include a supply nozzle 71 and a slurry storage tank 73. The supply nozzle 71 may be selectively disposed on a certain position on the polishing pad PP. The slurry may be discharged through the supply nozzle 71 onto the top surface of the polishing pad PP. The slurry storage tank 73 may supply the slurry to the supply nozzle 71. A bottom surface of the substrate may be polished with the slurry that is supplied from the slurry supply apparatus 7.

The conditioning apparatus 9 may polish a portion of the polishing pad PP. The conditioning apparatus 9 may include a conditioning supporter 91, a conditioning driver 93, and a conditioning disk 95. The conditioning supporter 91 may support the conditioning disk 95. For example, the conditioning disk 95 may be coupled to a bottom surface of the conditioning supporter 91. The conditioning driver 93 may selectively place the conditioning supporter 91 on the polishing pad PP. For example, the conditioning driver 93 may drive the conditioning supporter 91 to move in one or both of horizontal and vertical directions, and thus the conditioning supporter 91 may be disposed on the polishing pad PP. The conditioning driver 93 may include an actuator such as an electric motor or a hydraulic motor. The conditioning disk 95 may be detachably coupled to a lower portion of the conditioning supporter 91. The conditioning disk 95 may contact and polish the top surface of the polishing pad PP.

The polishing pad PP may be positioned on the platen 1. For example, the polishing pad PP may be detachably coupled to the platen 1. The polishing pad PP may have a circular shape when viewed in plan. For example, the polishing pad PP may have a disk shape whose center is coincident with the central axis AX1 of the platen 1. The polishing pad PP may polish the bottom surface of the substrate. As discussed above, the top surface of the polishing pad PP may have the polishing location PA at its region in contact with the substrate. The polishing pad PP will be further discussed in detail below.

Figure 2:
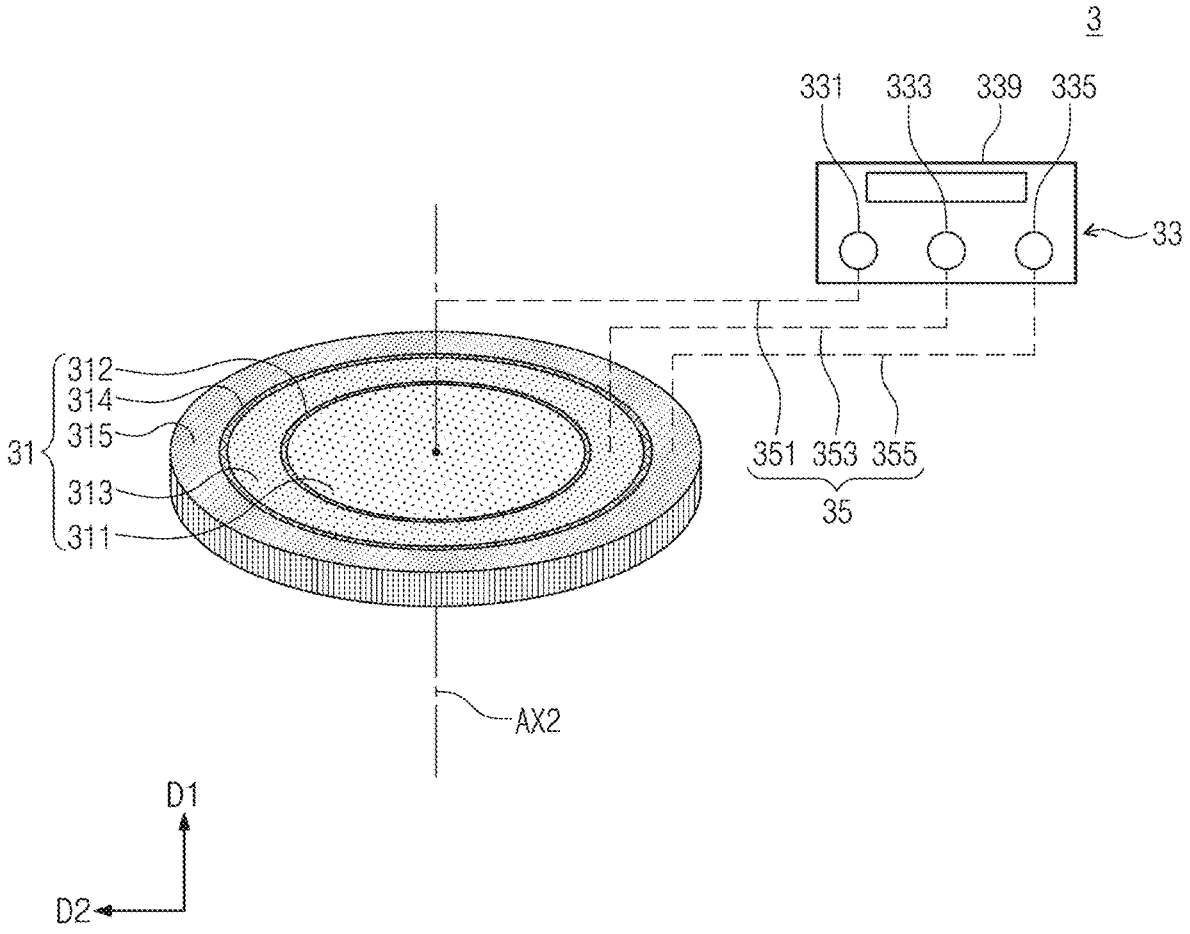
FIG. 2 illustrates a perspective view showing an electric field applying module of a substrate polishing system according to some embodiments of inventive concepts.

FIG. 2 illustrates a perspective view showing an electric field applying module of a substrate polishing system according to some embodiments of inventive concepts.

Referring to FIG. 2, the inner electrode 31 may include a first dielectric layer 312 and a second dielectric layer 314. The first dielectric layer 312 may be inserted between the first electrode 311 and the second electrode 313. The first dielectric layer 312 may have an annular shape that surrounds the first electrode 311. Therefore, the first electrode 311 and the second electrode 313 may not be in contact with each other. For example, the first dielectric layer 312 may electrically insulate the first electrode 311 from the second electrode 313. The second dielectric layer 314 may be inserted between the second electrode 313 and the third electrode 315. The second dielectric layer 314 may have an annular shape that surrounds the second electrode 313. Therefore, the second electrode 313 and the third electrode 315 may not be in contact with each other. For example, the second dielectric layer 314 may electrically insulate the second electrode 313 from the third electrode 315. It will be described that the inner electrode 31 includes three electrodes and two dielectric layers, but inventive concepts are not limited thereto. For example, the inner electrode 31 may include only two electrodes or may include four or more electrodes. Moreover, in FIGS. 1 and 2 to 16, an illustration of dielectric layers will be omitted in the interest of convenience.

The voltage applying device 33 may include a voltage applying body 339, a first port 331, a second port 333, and a third port 335. The voltage applying body 339 may have therein a component configured to outwardly deliver a plurality of different voltages from each other. For example, the voltage applying body 339 may be provided therein with a first voltage applier for delivering a first voltage to the first electrode 311. In addition, the voltage applying body 339 may be provided therein with a second voltage applier for delivering a second voltage to the second electrode 313. The first port 331 may be connected to the first electrode 311. For example, the first voltage applier may be connected through the first port 331 to the first electrode 311. The second port 333 may be connected to the second electrode 313. The third port 335 may be connected to the third electrode 315.

The voltage delivery member 35 may include a first delivery member 351, a second delivery member 353, and a third delivery member 355. The first delivery member 351 may be connected through the first port 331 to the voltage applying device 33. The first voltage may be delivered from the voltage applying device 33 through the first delivery member 351 to the first electrode 311. The second delivery member 353 may be connected through the second port 333 to the voltage applying device 33. The second voltage may be delivered from the voltage applying device 33 through the second delivery member 353 to the second electrode 313. The second voltage may be different from the first voltage. The third delivery member 355 may be connected through the third port 335 to the voltage applying device 33. A third voltage may be delivered from the voltage applying device 33 through the third delivery member 355 to the third electrode 315. The third voltage may be different from the second voltage. One or more features of the voltage applying device 33 may be implemented with power circuitry.

Figure 3:
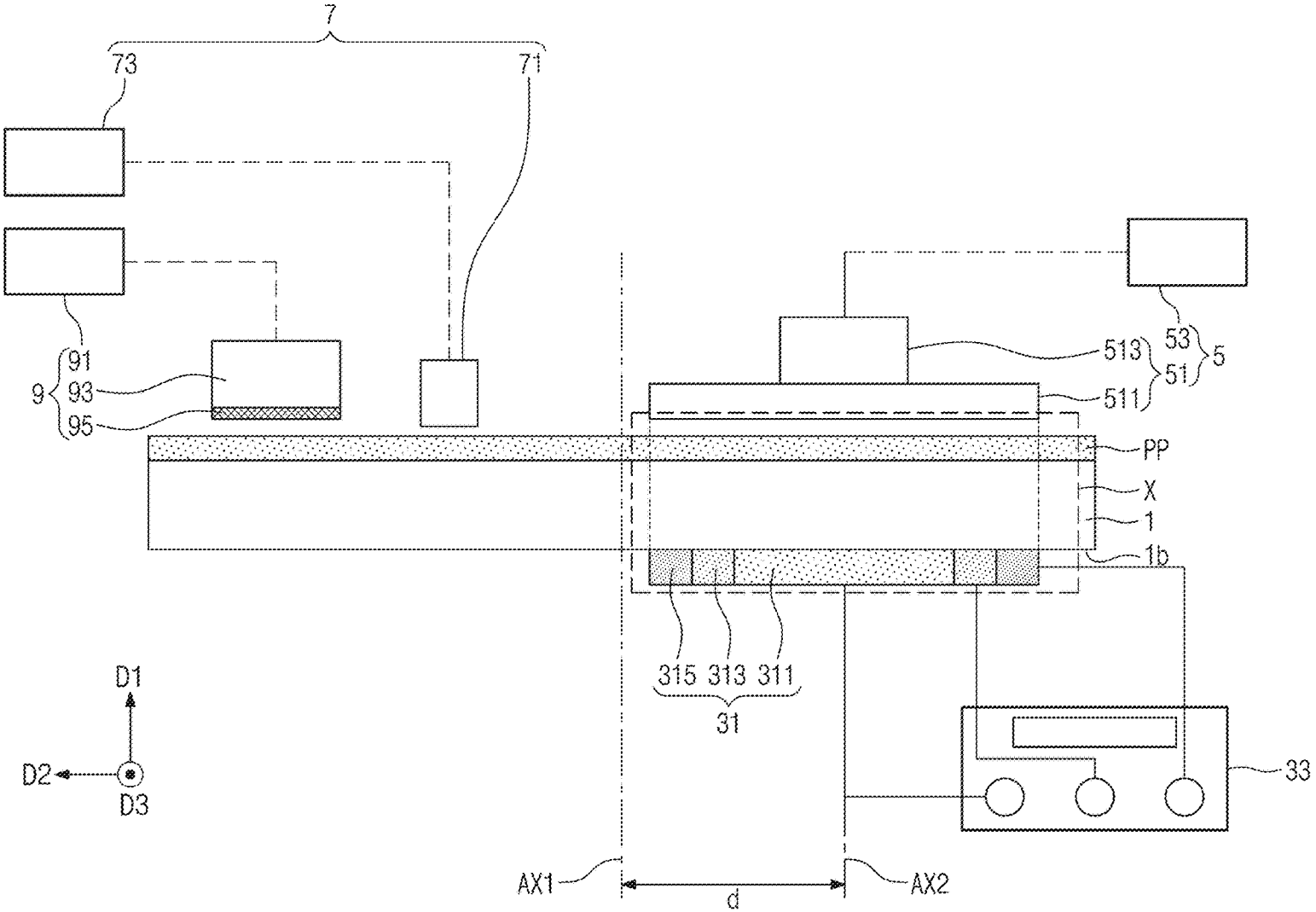
FIG. 3 illustrates a side view showing a substrate polishing system according to some embodiments of inventive concepts.
Figure 4:
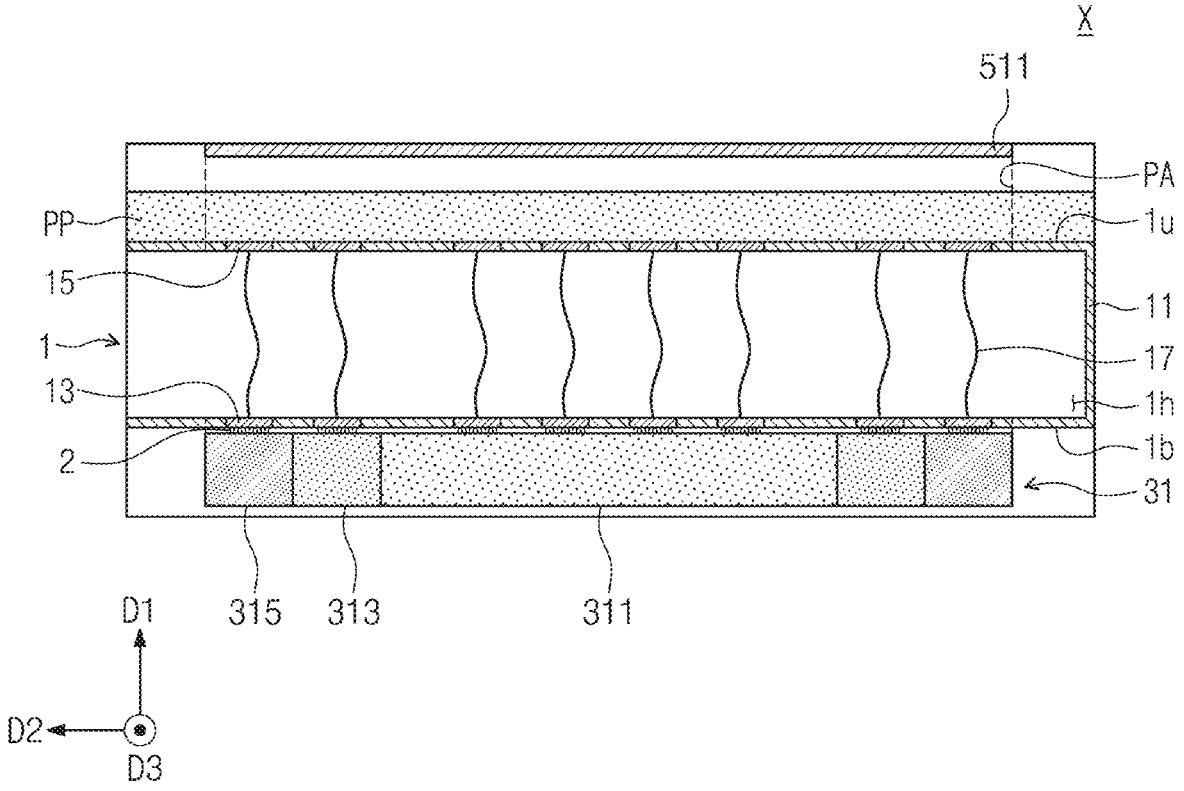
FIG. 4 illustrates an enlarged cross-sectional view showing section X of FIG. 3.

FIG. 3 illustrates a side view showing a substrate polishing system according to some embodiments of inventive concepts. FIG. 4 illustrates an enlarged cross-sectional view showing section X of FIG. 3.

Referring to FIGS. 3 and 4, a connection electrode 2 may be further provided. The connection electrode 2 may connect the inner electrode 31 to the platen 1. For example, the connection electrode 2 may electrically connect the fixed inner electrode 31 to the rotating platen 1. The connection electrode 2 may have a bottom end in contact with the inner electrode 31. A top end of the connection electrode 2 may be in contact with a bottom surface 1*b* of the platen 1. The connection electrode 2 may have an end coupled to the inner electrode 31 or the platen 1. For example, the bottom end of the connection electrode 2 may be fixedly coupled to the top surface of the inner electrode 31. In this case, the top end of the connection electrode 2 may be in contact with a bottom surface 1*b* of the platen 1, but may not be coupled to the platen 1. Alternatively, the top end of the connection electrode 2 may be fixedly coupled to the bottom surface 1*b* of the platen 1. In this case, the bottom end of the connection electrode 2 may be in contact with the top surface of the inner electrode 31, but may not be coupled to the inner electrode 31. The connection electrode 2 may include a conductive textile material. For example, the connection electrode 2 may include flexible fibrous conductive material. Therefore, even when the platen 1 rotates on the fixed inner electrode 31, the connection electrode 2 may be prevented from fracture or abrasion. The connection electrode 2 may be provided in plural. For convenience, the following description will focus on a single connection electrode 2.

The platen 1 may include a platen body 11, a lower electrode 13, an upper electrode 15, and a connection member 17.

The platen body 11 may provide an internal space 1*h*. The platen body 11 may have a hollow cylindrical shape that surrounds the internal space 1*h*.

The lower electrode 13 may be coupled to a lower portion of the platen body 11. The lower electrode 13 may be exposed toward a lower portion of the platen 1. For example, the lower electrode 13 may be exposed on a bottom surface of the platen body 11 or the bottom surface 1*b* of the platen 1. The lower electrode 13 may be electrically connected to the connection electrode 2. The lower electrode 13 may be electrically connected through the connection electrode 2 to the inner electrode 31. The lower electrode 13 may be provided in plural. The plurality of lower electrodes 13 may be disposed spaced apart from each other. The plurality of lower electrodes 13 may be correspondingly electrically connected to a plurality of electrodes provided in the inner electrode 31. For convenience, the following description will focus on a single lower electrode 13.

The upper electrode 15 may be coupled to an upper portion of the platen body 11. The upper electrode 15 may be exposed toward an upper portion of the platen 1. For example, the upper electrode 15 may be exposed on a top surface of the platen body 11 or the top surface 1*u* of the platen 1. Inventive concepts, however, are not limited thereto, and the upper electrode 15 may not be exposed, but may be embedded in the platen body 11. The upper electrode 15 may be electrically connected to the connection member 17. The upper electrode 15 may be electrically connected through the connection member 17 to the lower electrode 13. The upper electrode 15 may be provided in plural. The plurality of upper electrodes 15 may be disposed spaced apart from each other. The plurality of upper electrodes 15 may be correspondingly electrically connected to the plurality of lower electrodes 13. For convenience, the following description will focus on a single upper electrode 15.

The connection member 17 may electrically connect the lower electrode 13 to the upper electrode 15. The connection member 17 may be coupled to a top surface of the lower electrode 13 and to a bottom surface of the upper electrode 15. The connection member 17 may include a flexible material such as an electric wire, but inventive concepts are not limited thereto. The connection member 17 may be provided in plural. The plurality of connection members 17 may correspondingly electrically connect the plurality of lower electrodes 13 to the plurality of upper electrodes 15. For convenience, the following description will focus on a single connection member 17.

A voltage applied to the inner electrode 31 may be transferred to the upper electrode 15 through the connection electrode 2, the lower electrode 13, and the connection member 17. The upper electrode 15 may generate an electric field on the polishing pad PP.

Figure 5:
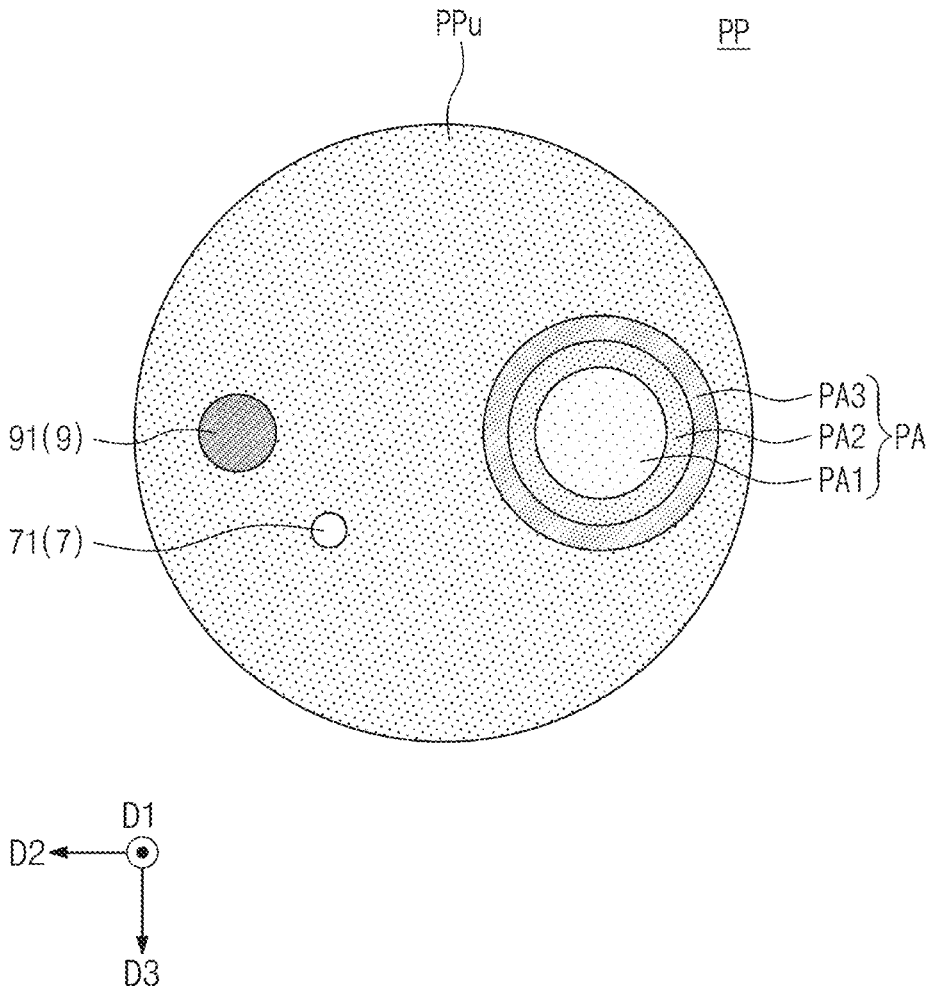
FIG. 5 illustrates a plan view showing a substrate polishing system according to some embodiments of inventive concepts.

FIG. 5 illustrates a plan view showing a substrate polishing system according to some embodiments of inventive concepts.

Referring to FIG. 5, the polishing location PA may be divided into a first polishing area PA1, a second polishing area PA2, and a third polishing area PA3.

The first polishing area PA1 may have a circular shape. The first polishing area PA1 may have a center that is not coincident with that of a top surface PPu of the polishing pad (see PP of FIG. 1). The first polishing area PA1 may be positioned on the first electrode (see 311 of FIG. 1). In this case, the first electrode 311 may be disposed beneath the first polishing area PA1. For example, the first electrode 311 may be disposed at a position to which the first polishing area PA1 is vertically downwardly projected.

The second polishing area PA2 may surround the first polishing area PA1. The second polishing area PA2 may have an annular shape. The second polishing area PA2 may be positioned on the second electrode (see 313 of FIG. 1). In this case, the second electrode 313 may be disposed beneath the second polishing area PA2. For example, the second electrode 313 may be disposed at a position to which the second polishing area PA2 is vertically downwardly projected.

The third polishing area PA3 may surround the second polishing area PA2. The third polishing area PA3 may have an annular shape. The third polishing area PA3 may be positioned on the third electrode (see 315 of FIG. 1). In this case, the third electrode 315 may be disposed beneath the third polishing area PA3. For example, the third electrode 315 may be disposed at a position to which the third polishing area PA3 is vertically downwardly projected.

Figure 6:
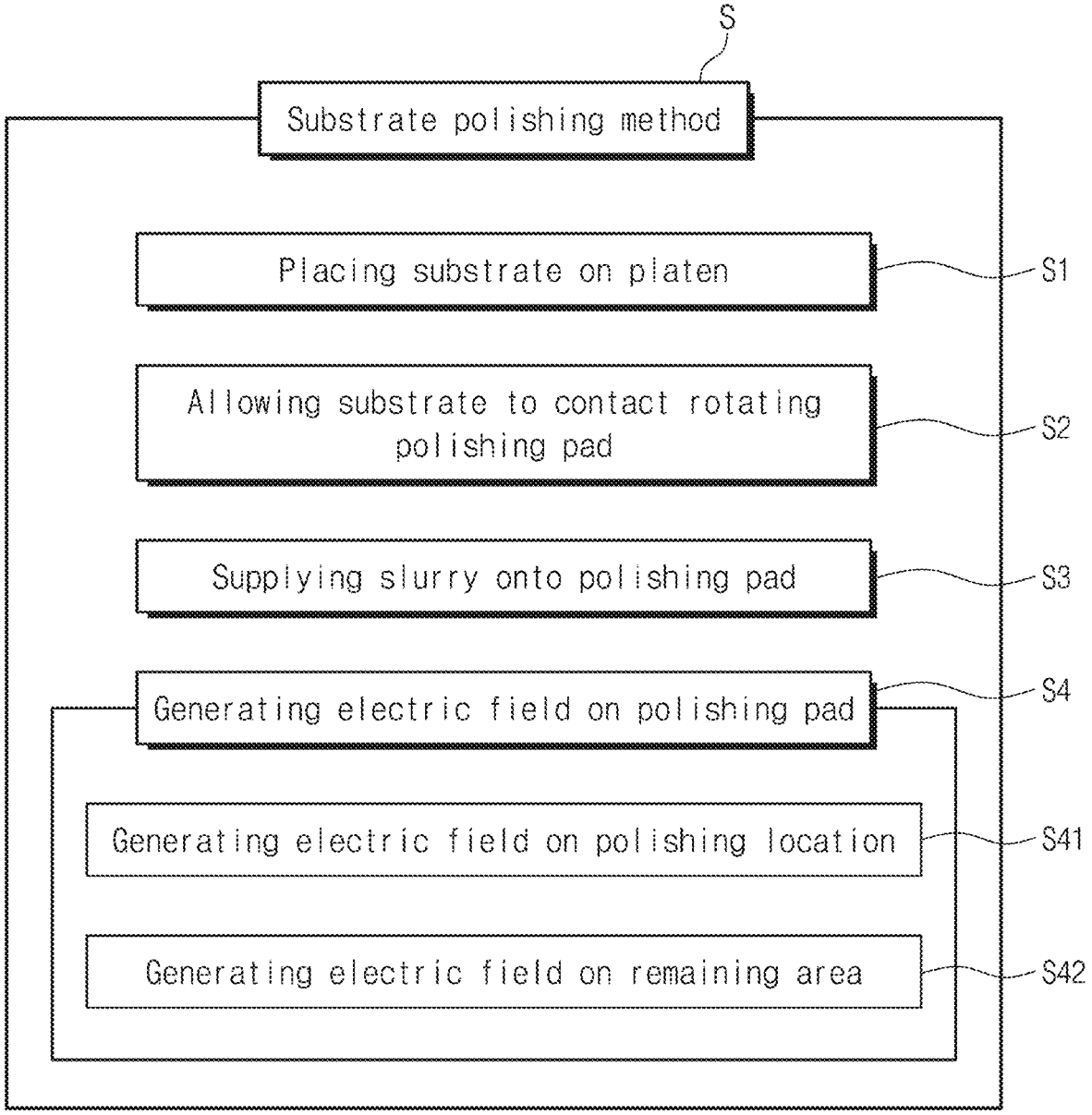
FIG. 6 illustrates a flow chart showing a substrate polishing method according to some embodiments of inventive concepts.

FIG. 6 illustrates a flow chart showing a substrate polishing method according to some embodiments of inventive concepts.

Referring to FIG. 6, a substrate polishing method S may be provided. The substrate polishing method S may use the substrate polishing apparatus (see substrate polishing apparatus A of FIG. 1) and the substrate polishing system (see ST of FIG. 1) including the substrate polishing apparatus A. The substrate polishing method S may include an operation S1 of placing a substrate on a platen, an operation S2 of contact the substrate with a polishing pad during its rotation, an operation S3 of supplying slurry onto the polishing pad, and an operation S4 of generating an electric field on the polishing pad.

The electric field generation operation S4 may include an operation S41 of generating an electric field on a polishing location and an operation S42 of generating an electric field on a remaining area.

Figure 7:
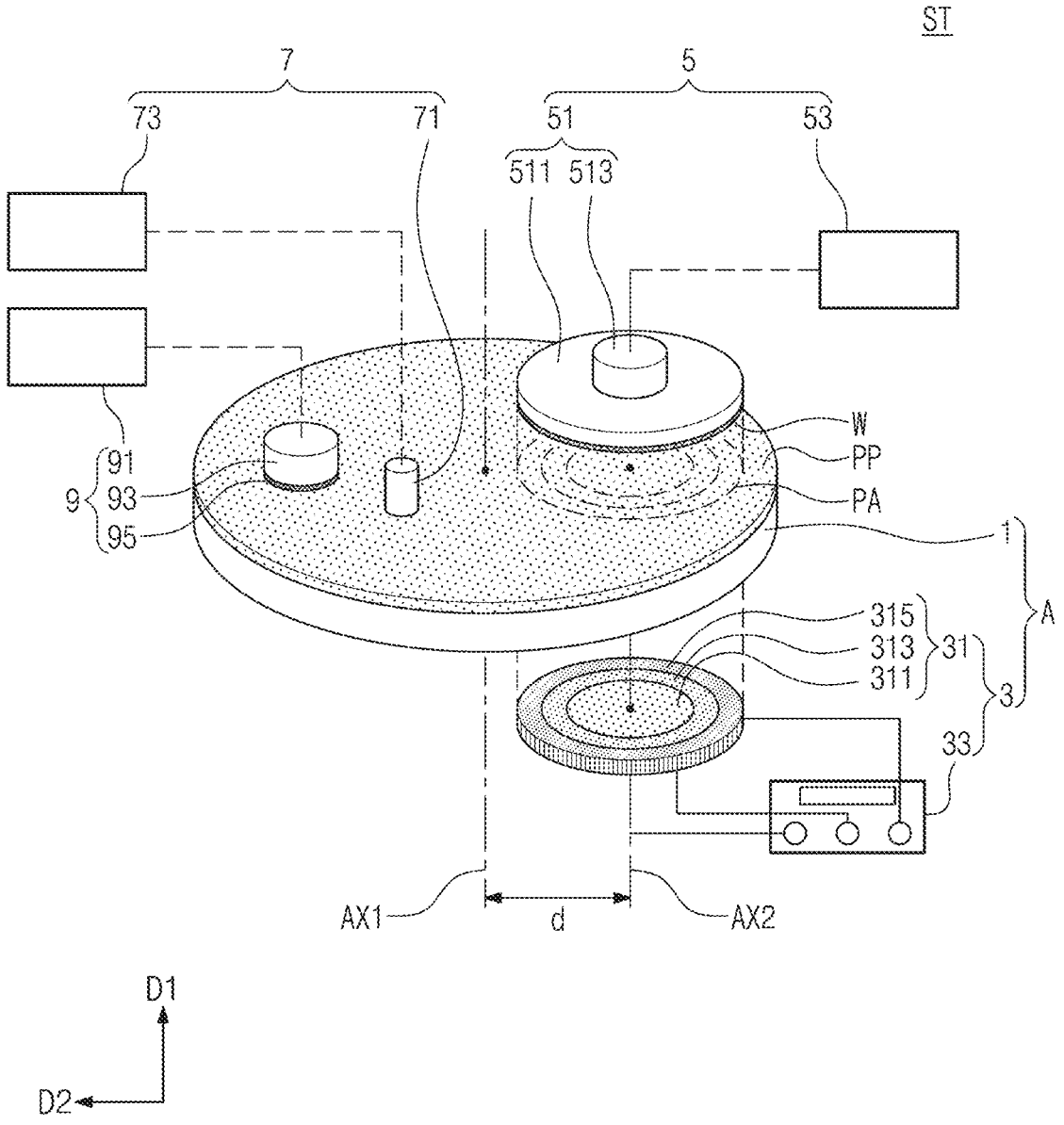
FIGS. 7 to 9 illustrate diagrams showing a substrate polishing method according to the flow chart of FIG. 6.
Figure 8:
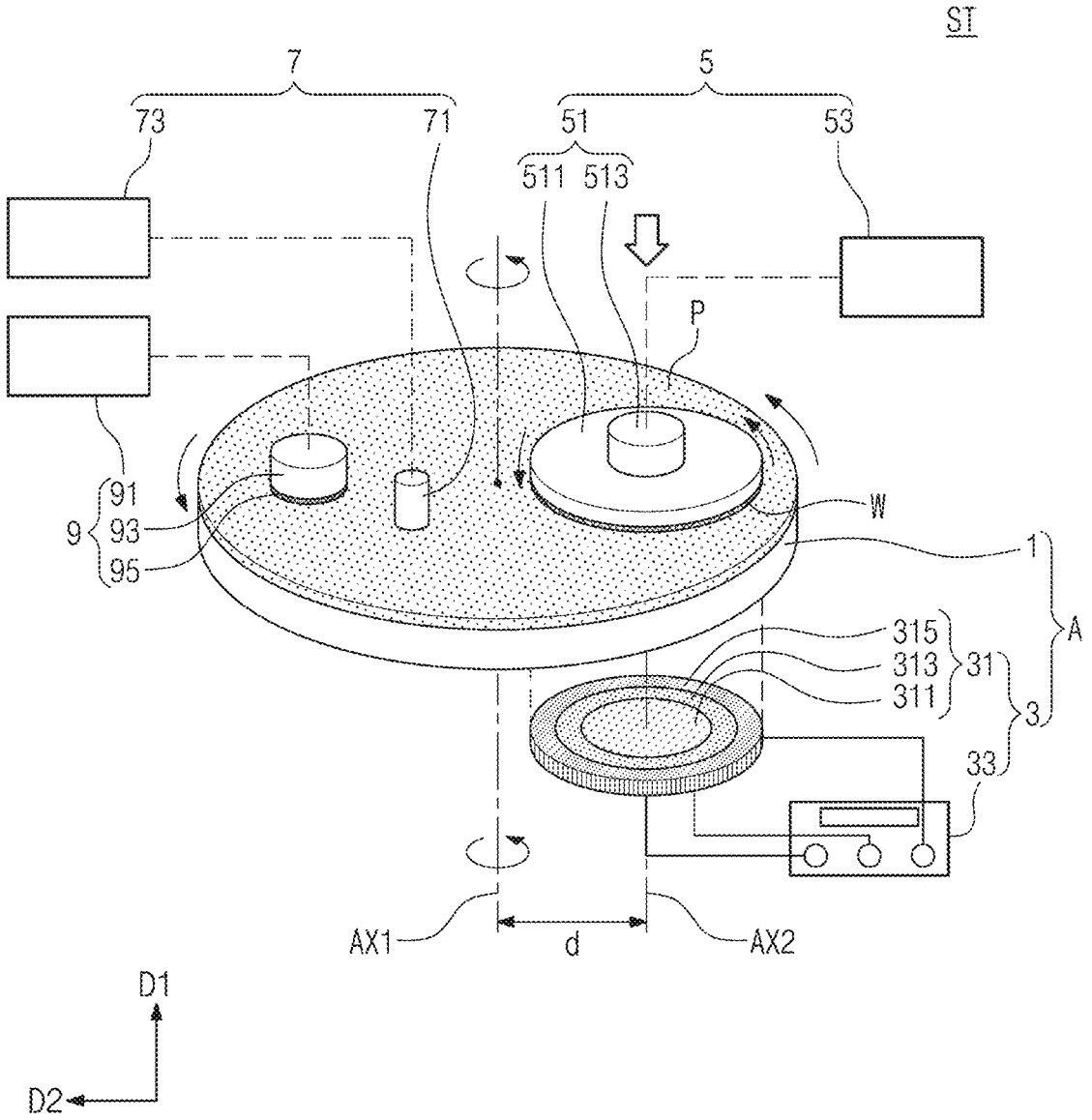
Figure 9:
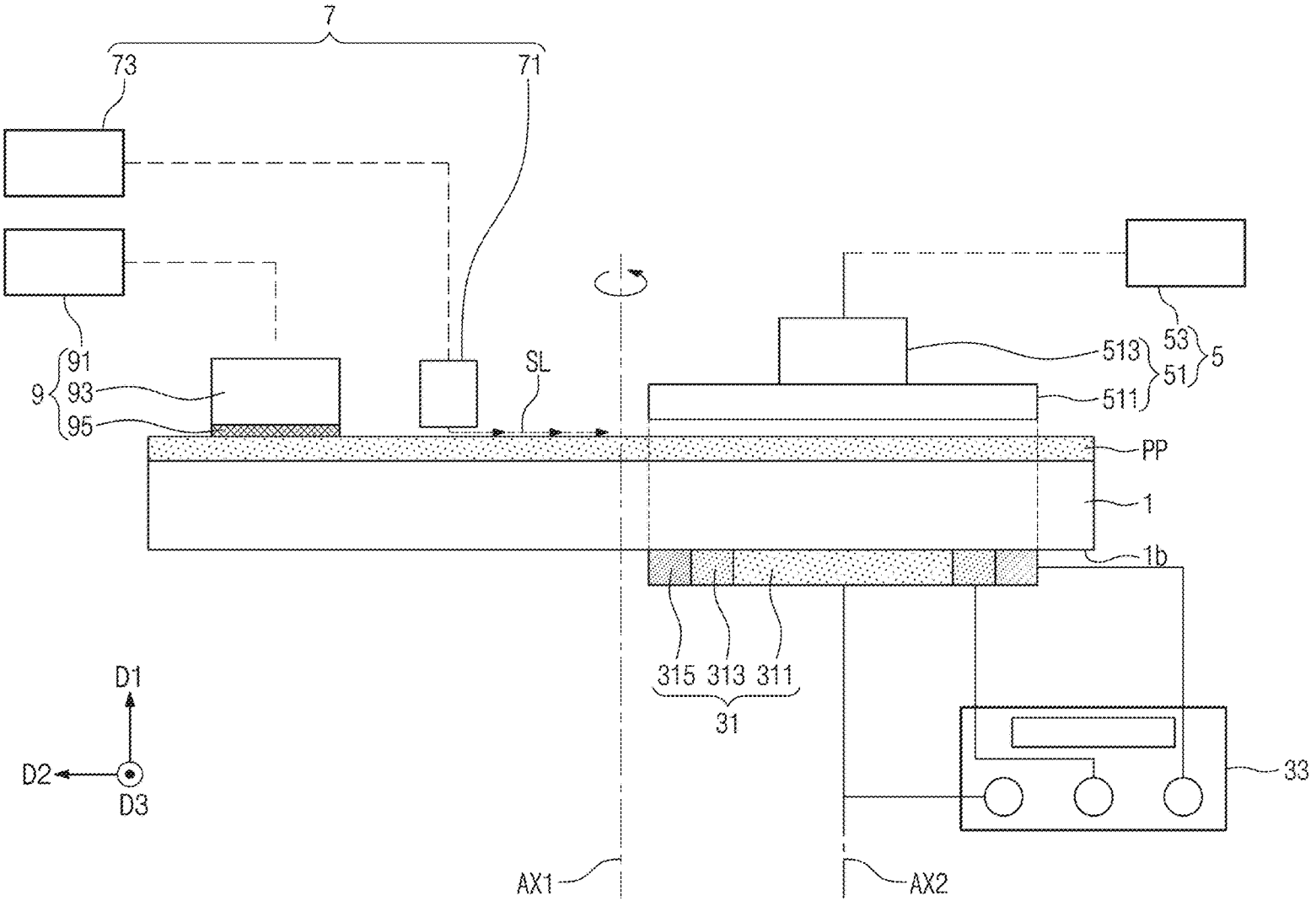

With reference to FIGS. 7 to 9, the following will discuss in detail each operation of the substrate polishing method S shown in FIG. 6.

FIGS. 7 to 9 illustrate diagrams showing a substrate polishing method according to the flow chart of FIG. 6.

Referring to FIGS. 6 and 7, the substrate placement operation S1 may include allowing the polishing head 51 to place a substrate W on the platen 1. For example, the polishing head 51 may be disposed on the polishing pad PP while the substrate W is adsorbed on a bottom surface of the polishing head body 511. The substrate W may be disposed on the polishing location PA. A bottom surface of the substrate W may face the top surface of the polishing pad PP. For example, the bottom surface of the substrate W may face the polishing location PA.

Referring to FIGS. 6 and 8, the substrate contact operation S2 may include allowing the polishing head 51 to descend to force the substrate W into contact with the polishing pad PP. On the polishing location PA, the substrate W may be in contact with the polishing pad PP. When the platen 1 rotates about the central axis AX1, the polishing pad PP on the platen 1 may also rotate about the central axis AX1. The rotation of the polishing head 51 may drive the substrate W to rotate. Therefore, the bottom surface of the rotating substrate W may be in contact with the top surface of the rotating polishing pad PP. In this case, the inner electrode 31 may not rotate. Alternatively, the inner electrode 31 may rotate in place about the central axis AX2 thereof. In some embodiments, the substrate contact operation S2 may further include allowing the substrate W to perform a translational motion. For example, the substrate W may rotate about an axis parallel to the first direction D1, and may perform a reciprocal motion in a horizontal direction while being in contact with the polishing pad PP. In addition, the substrate contact operation S2 may further include allowing each of the first and second electrodes 311 and 313 to perform a translational motion. For example, the inner electrode 31 may perform a reciprocal motion in a horizontal direction. For more detail, the inner electrode 31 may be synchronized with the translational motion of the substrate W to perform a translational motion following the substrate W. The inner electrode 31, which generates an electric field on the bottom surface of the substrate W, may move following the substrate W when the substrate W migrates. Therefore, even when the substrate W migrates, an electric field may be generated on a specific position on the bottom surface of the substrate W.

Referring to FIGS. 6 and 9, the slurry supply operation S3 may include allowing the slurry supply apparatus 7 to supply slurry SL onto the top surface of the polishing pad PP. For example, the slurry SL may be downwardly discharged from the supply nozzle 71 and may be sprayed on the polishing pad PP during its rotation. The slurry SL may move along the top surface of the polishing pad PP during its rotation. For example, the slurry SL may move along the top surface of the polishing pad PP during its rotation and toward a position below the substrate W. An infinitesimal space may be present between the substrate W and the top surface of the polishing pad PP. A portion of the slurry SL may move to the space between the substrate W and the top surface of the polishing pad PP. Another portion of the slurry SL may not move to a position below the substrate W.

The electric field generation operation S41 may include allowing the electric field applying module 3 to generate an electric field on the polishing location PA. The voltage applying device 33 may supply the inner electrode 31 with a voltage to generate the electric field on the polishing location PA. For example, the voltage applied to the inner electrode 31 may be delivered to the upper electrode 15 through the connection electrode 2, the lower electrode 13, and the connection member 17 (see FIG. 2). The voltage applied to the upper electrode 15 may generate the electric field on the polishing pad PP. For example, the first electrode 311 may be supplied with a first voltage to generate a first electric field on the first polishing area (see PA1 of FIG. 5). In addition, the second electrode 313 may be supplied with a second voltage to generate a second electric field on the second polishing area (see PA2 of FIG. 5). In further addition, the third electrode 315 may be supplied with a third voltage to generate a third electric field on the third polishing area (see PA3 of FIG. 5). A voltage charged on the polishing location PA may control behavior of slurry particles introduced between the substrate W and the polishing pad PP. The slurry particles on the polishing location PA may be charged at a certain charge level. The first electric field generated on the first polishing area PA1 may cause the slurry particles to experience a force in a certain direction. For example, the first electric field may cause the slurry particles to experience a force in an upward direction. In this case, the slurry particles introduced between the substrate W and the polishing pad PP may move toward the substrate W. For another example, the first electric field may cause the slurry particles to experience a force in a downward direction. In this case, the slurry particles introduced between the substrate W and the polishing pad PP may move toward the polishing pad PP. The first electric field, the second electric field, and the third electric field may be appropriately adjusted to separately control behavior of the slurry particles for each area in the polishing location PA.

The electric field generation operation S42 may include generating an electric field on an area other than the polishing location PA. For example, an electric field may be generated not only on the polishing location PA but also on a remaining area. The electric field generated on the polishing pad PP may be different from that generated on the remaining area. A detailed description thereof will be further discussed below with reference to FIGS. 11 to 16.

According to a substrate polishing apparatus, a substrate polishing system including the same, and a substrate polishing method using the same in accordance with some embodiments of inventive concepts, an electric field may be separately adjusted for each area to control behavior of slurry particles. For example, it may be possible to control whether the slurry particles move toward a polishing pad or toward a substrate in a polishing location where the polishing pad and the substrate are in contact with each other. For more detail, behavior of the slurry particles may be separately controlled by using an inner electrode that includes a plurality of electrodes having concentrically circular shapes and by dividing the polishing location into a plurality of areas having different diameters. The substrate may thus be regionally controlled in its abrasion caused by the slurry particles. Accordingly, it may be possible to increase yield and substrate polishing efficiency.

According to a substrate polishing apparatus, a substrate polishing system including the same, and a substrate polishing method using the same in accordance with some embodiments of inventive concepts, a voltage may be applied by using an electric field applying module positioned beneath a platen. As the inner electrode is spaced apart from and disposed beneath the platen, the inner electrode may not rotate even when the platen rotates. Therefore, it may be possible to fix the inner electrode to a certain position below the polishing location. Thus, while the platen is rotating, it may be possible to precisely control an electric field in a space below the substrate polished at the certain position. Hence, it may be possible to increase polishing efficiency. In addition, because the electrodes of the inner electrode are not affected by the rotation of the platen, it may be easy to separately control the electrodes. For example, because an electric field is generated by applying a voltage to the electrodes in a fixed state, the easy control may be achieved.

Figure 10:
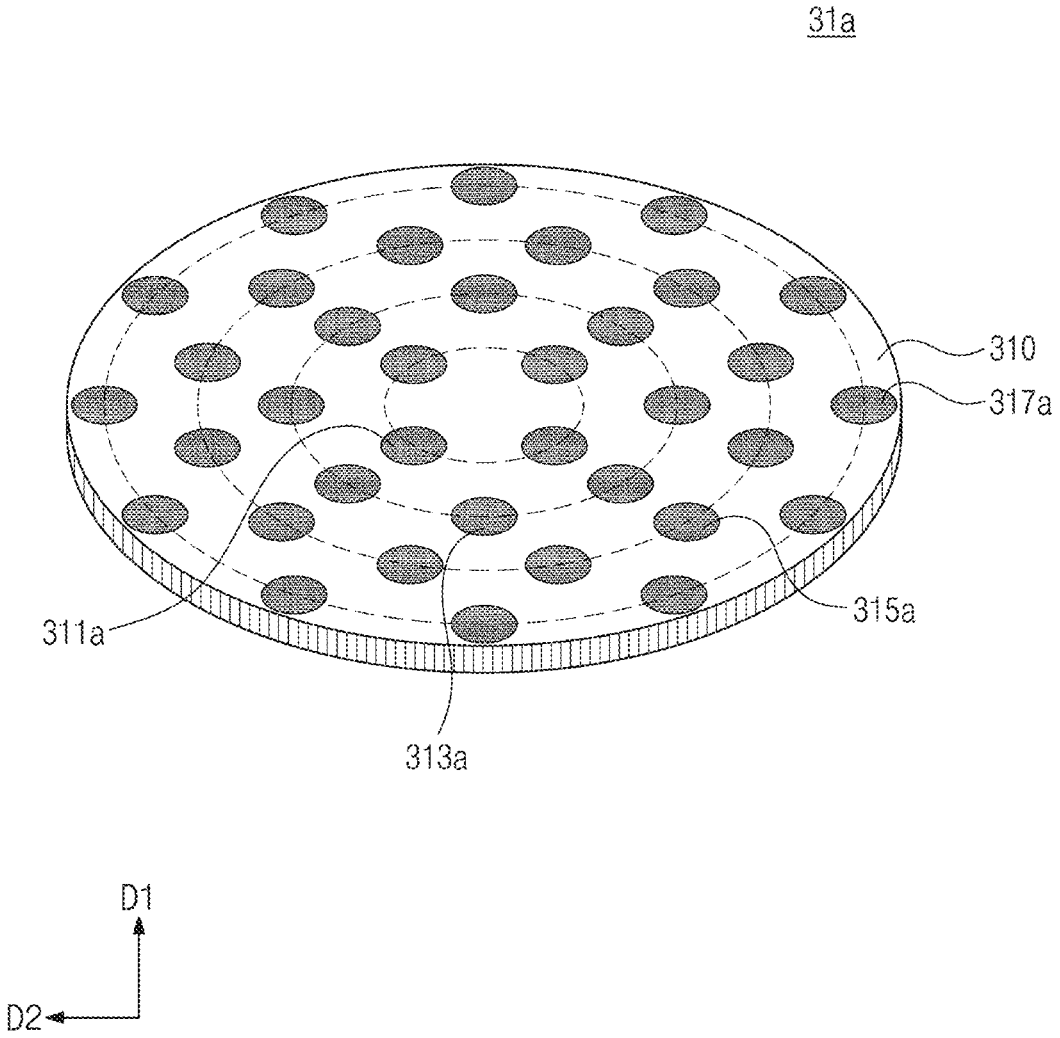
FIG. 10 illustrates a perspective view showing an electric field applying module of a substrate polishing system according to some embodiments of inventive concepts.

FIG. 10 illustrates a perspective view showing an electric-field supply module of a substrate polishing system according to some embodiments of inventive concepts.

The following will omit explanation of components the same as or similar to those discussed with reference to FIGS. 1 to 9.

Referring to FIG. 10, an inner electrode 31*a* may be provided. Different from the inner electrode 31 discussed with reference to FIG. 2, the inner electrode 31*a* of FIG. 10 may include an inner electrode body 310, a plurality of first split electrodes 311*a*, a plurality of second split electrodes 313*a*, a plurality of third split electrodes 315*a*, and a plurality of fourth split electrodes 317*a*.

The plurality of first split electrodes 311*a* may be coupled to the inner electrode body 310. The plurality of first split electrodes 311*a* may be arranged in a circumferential direction. The plurality of first split electrodes 311*a* may be collectively called a first electrode. For example, the first electrode may be a group of the plurality of first split electrodes 311*a*.

The plurality of second split electrodes 313*a* may be coupled to the inner electrode body 310. The plurality of second split electrodes 313*a* may be arranged in a circumferential direction. The plurality of second split electrodes 313*a* may surround the plurality of first split electrodes 311*a*. The plurality of second split electrodes 313*a* may be collectively called a second electrode. For example, the second electrode may be a group of the plurality of second split electrodes 313*a*.

The plurality of third split electrodes 315*a* may be coupled to the inner electrode body 310. The plurality of third split electrodes 315*a* may be arranged in a circumferential direction. The plurality of third split electrodes 315*a* may surround the plurality of second split electrodes 313*a*. The plurality of third split electrodes 315*a* may be collectively called a third electrode. For example, the third electrode may be a group of the plurality of third split electrodes 315*a*.

The plurality of fourth split electrodes 317*a* may be coupled to the inner electrode body 310. The plurality of fourth split electrodes 317*a* may be arranged in a circumferential direction. The plurality of fourth split electrodes 317*a* may surround the plurality of third split electrodes 315*a*. The plurality of fourth split electrodes 317*a* may be collectively called a fourth electrode. For example, the fourth electrode may be a group of the plurality of fourth split electrodes 317*a*.

Figure 11:
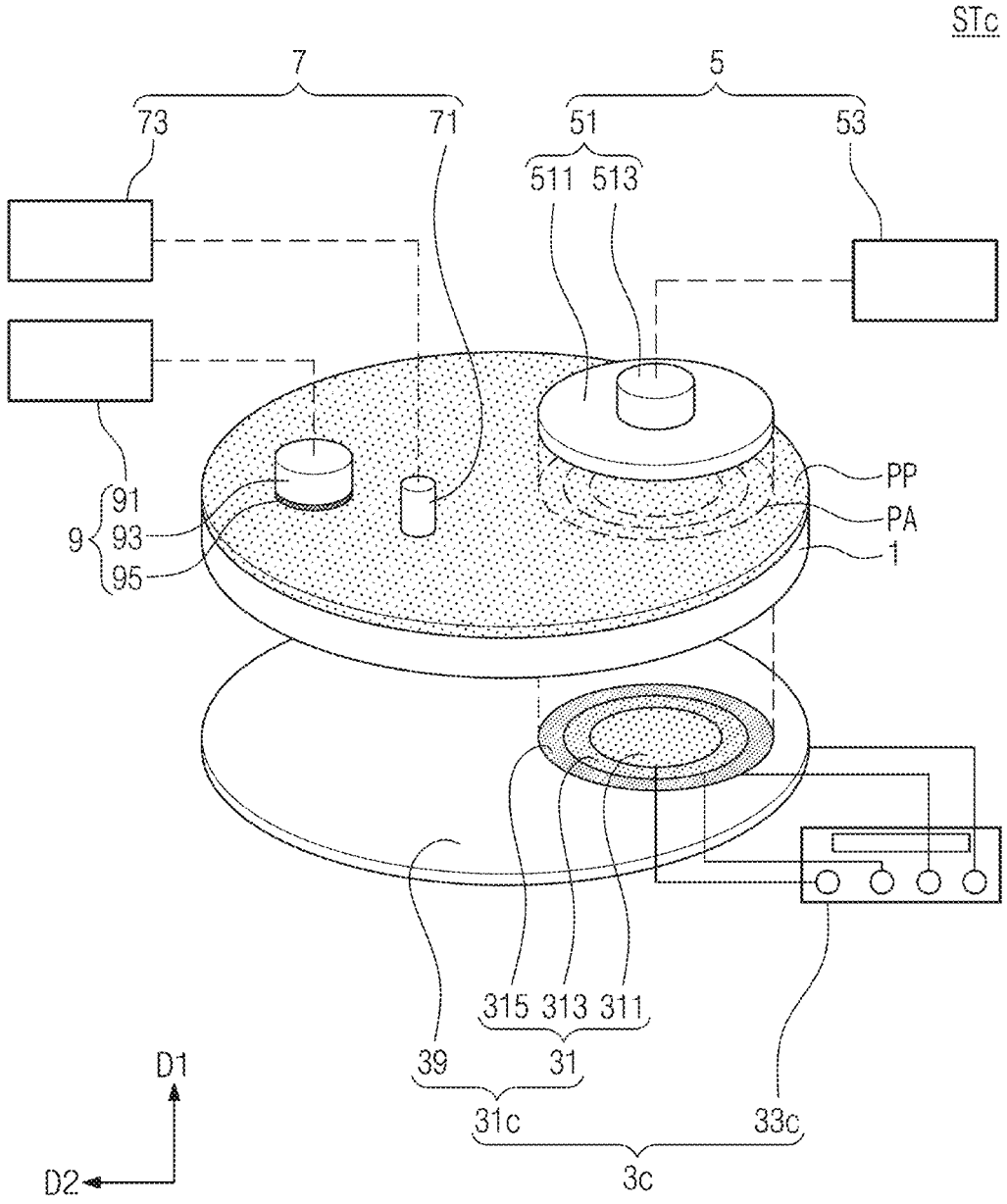
FIG. 11 illustrates a perspective view showing a substrate polishing system according to some embodiments of inventive concepts.

FIG. 11 illustrates a perspective view showing a substrate polishing system according to some embodiments of inventive concepts.

The following will omit explanation of components the same as or similar to those discussed with reference to FIGS. 1 to 10.

Referring to FIG. 11, a substrate polishing system STc may be provided. The substrate polishing system STc may include an electric field applying module 3*c*. The electric field applying module 3*c* may include an electrode part 31*c* and a voltage applying device 33*c*. The electrode part 31*c* may include an inner electrode 31 and an outer electrode 39. The outer electrode 39 may surround the inner electrode 31. The outer electrode 39 may have a circular shape when viewed in plan. The outer electrode 39 may have a central axis in substantially coincident with that of the platen 1. The outer electrode 39 may have a diameter substantially the same as or similar to that of the platen 1. For example, the diameter of the outer electrode 39 may range from about 700 mm to about 900 mm. For more detail, the diameter of the outer electrode 39 may be about 800 mm or about 750 mm. The outer electrode 39 may be connected to the voltage applying device 33*c*. The outer electrode 39 may receive a voltage from the voltage applying device 33*c*. The outer electrode 39 may generate an electric field on a remaining area other than the polishing location PA.

Figure 12:
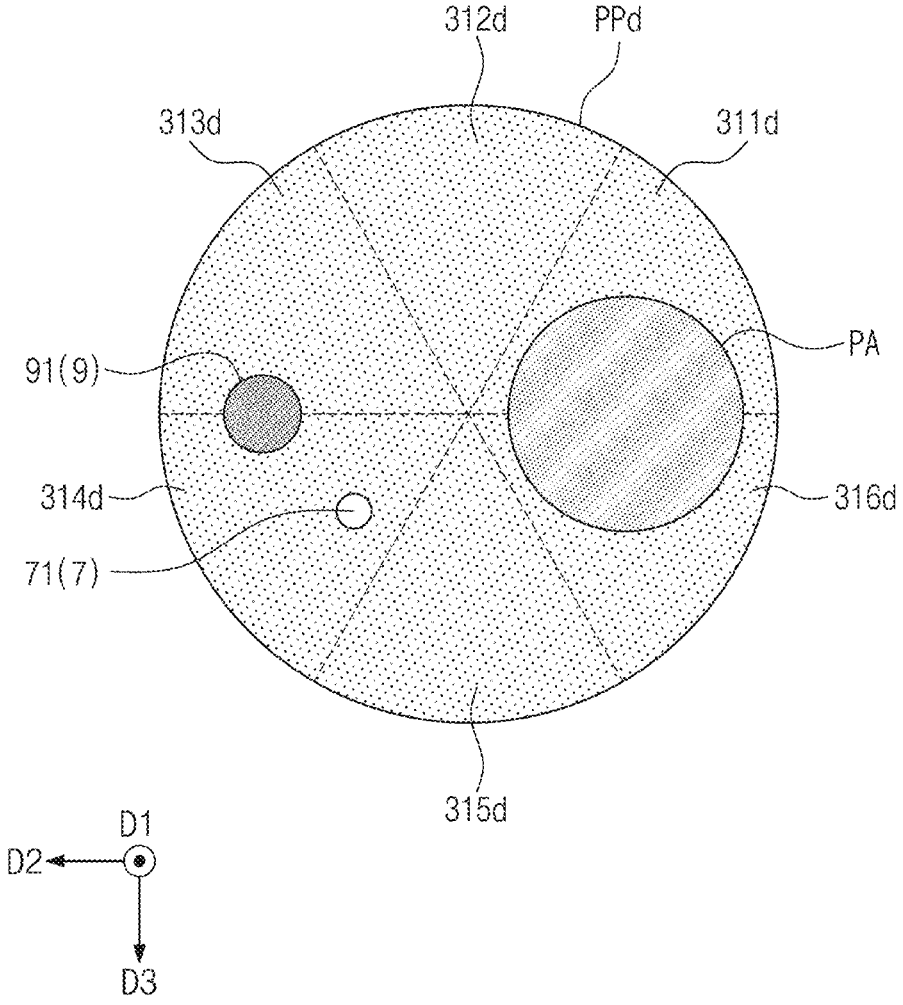
FIG. 12 illustrates a plan view showing a substrate polishing system according to some embodiments of inventive concepts.
Figure 13:
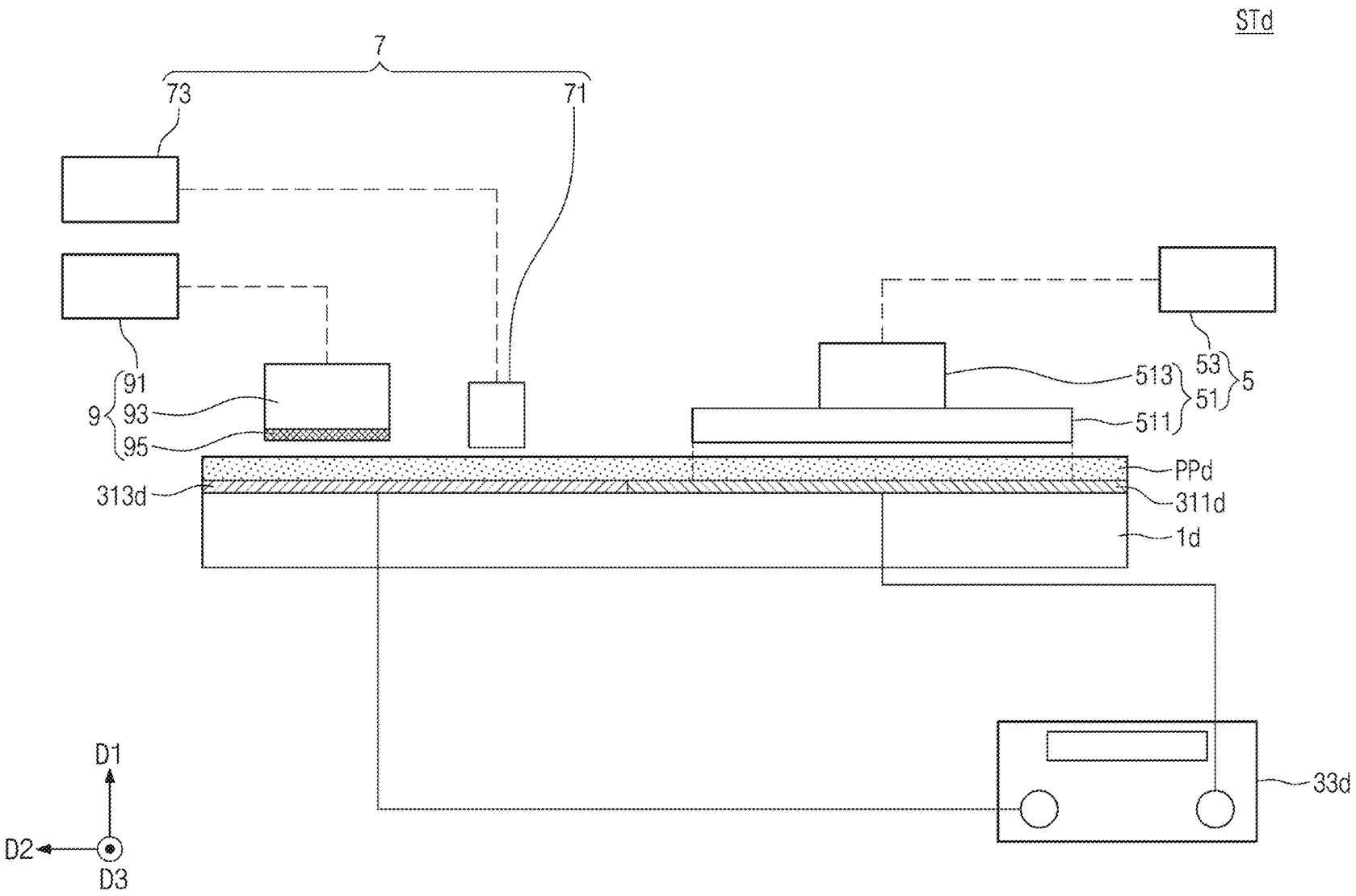
FIG. 13 illustrates a cross-sectional view showing a substrate polishing system according to some embodiments of inventive concepts.

FIG. 12 illustrates a plan view showing a substrate polishing system according to some embodiments of inventive concepts. FIG. 13 illustrates a cross-sectional view showing a substrate polishing system according to some embodiments of inventive concepts.

The following will omit explanation of components the same as or similar to those discussed with reference to FIGS. 1 to 11.

Referring to FIGS. 12 and 13, a substrate polishing system STd may include a platen electrode. The platen electrode may be positioned on a platen 1*d*. For example, the platen electrode may be positioned between the platen 1*d* and a polishing pad PPd. Therefore, when the platen 1*d* rotates, the platen electrode may rotate together with the polishing pad PPd. The platen electrode may be divided into a plurality of electrodes that are split in a circumferential direction. For example, the platen electrode may include a first electrode 311*d*, a second electrode 312*d*, a third electrode 313*d*, a fourth electrode 314*d*, a fifth electrode 315*d*, and a sixth electrode 316*d*.

Figure 14:
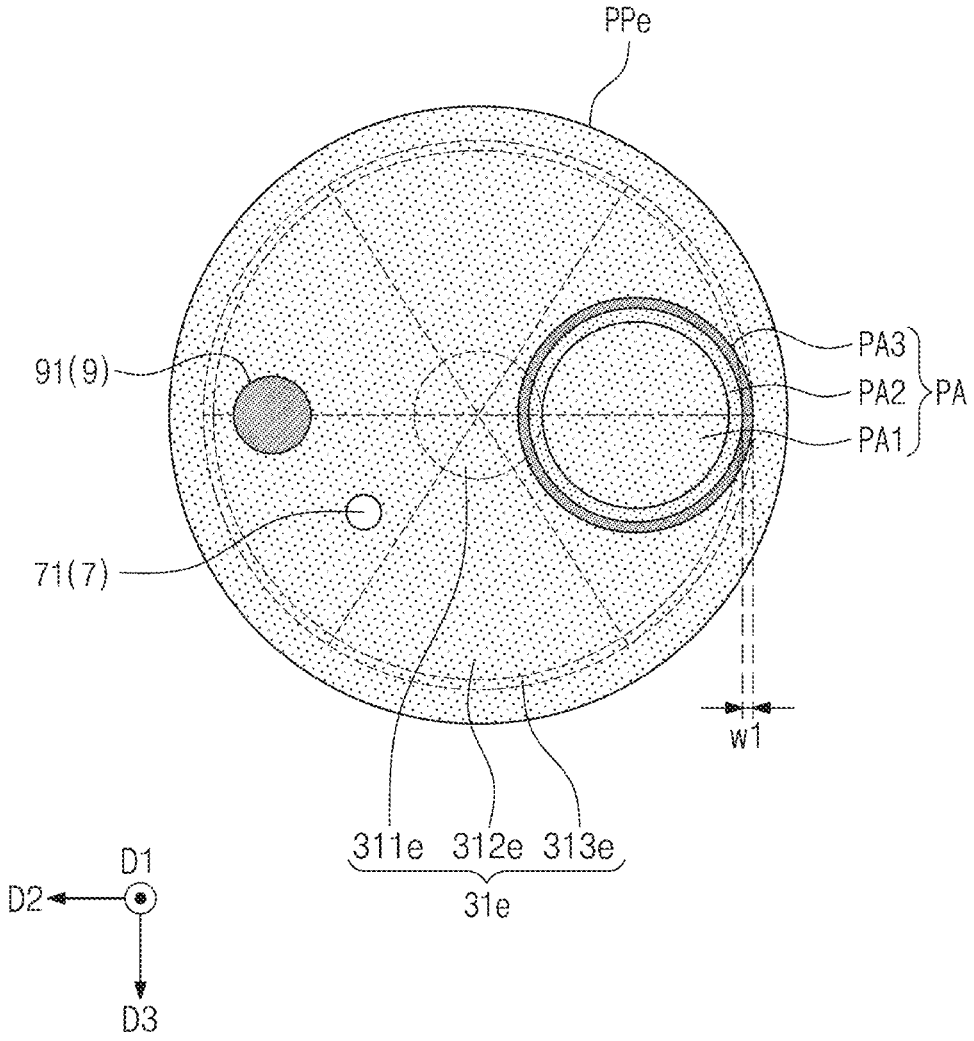
FIG. 14 illustrates a plan view showing a substrate polishing system according to some embodiments of inventive concepts.
Figure 15:
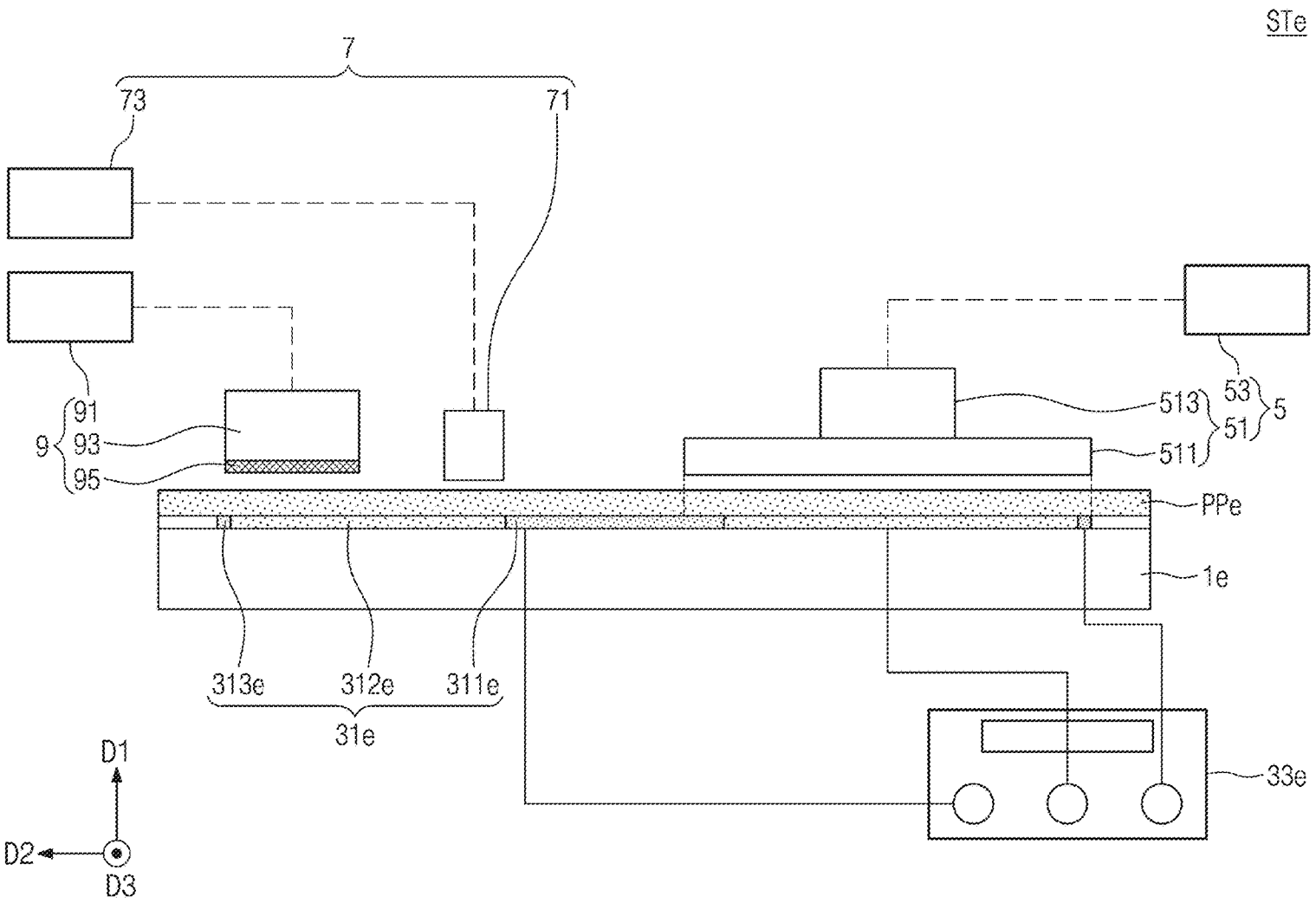
FIG. 15 illustrates a cross-sectional view showing a substrate polishing system according to some embodiments of inventive concepts.

FIG. 14 illustrates a plan view showing a substrate polishing system according to some embodiments of inventive concepts. FIG. 15 illustrates a cross-sectional view showing a substrate polishing system according to some embodiments of inventive concepts.

The following will omit explanation of components the same as or similar to those discussed with reference to FIGS. 1 to 13.

Referring to FIGS. 14 and 15, a substrate polishing system STe may include a platen electrode 31*e*. The platen electrode 31*e* may be positioned on the platen 1*e*. For example, the platen electrode 31*e* may be positioned between the platen 1*e* and a polishing pad PPe. Therefore, when the platen 1*e* rotates, the platen electrode 31*e* may rotate together with the polishing pad PPe. The platen electrode 31*e* may be electrically connected to a voltage applying device 33*e*. The platen electrode 31*e* may include a first electrode 311*e*, a second electrode 312*e*, and a third electrode 313*e*. The second electrode 312*e* may surround the first electrode 311*e*. The third electrode 313*e* may surround the second electrode 312*e*.

When viewed in plan, a region where the first electrode 311*e* overlaps the polishing location PA may be only the second polishing area PA2 and the third polishing area PA3. In this case, when viewed in plan, the first electrode 311*e* may not overlap the first polishing area PA1. When viewed in plan, a region where the third electrode 313*e* overlaps the polishing location PA may be only the third polishing area PA3. In this case, when viewed in plan, the third electrode 313*e* may overlap neither the first polishing area PA1 nor the second polishing area PA2. A first thickness w1 may be defined to indicate a maximum thickness in a radius direction of the region where the third electrode 313*e* overlaps the third polishing area PA3. The first thickness w1 may range from about 1 mm to about 8 mm. For example, the first thickness w1 may range from about 2 mm to about 6 mm.

It is explained above that the platen electrode 31*e* includes three electrodes, but inventive concepts are not limited thereto. For example, the platen electrode 31*e* may include two electrodes or may include four or more electrodes.

Each of the first, second, and third electrodes 311*e*, 312*e*, and 313*e* may be divided into a plurality of electrodes that are split in a circumferential direction of the platen 1*e*. For example, as shown in FIG. 14, the first electrode 311*e* may be divided into six first split electrodes. The second electrode 312*e* may also be divided into six second split electrodes. The third electrode 313*e* may also be divided into six third split electrodes. The plurality of first slit electrodes may be controlled independently of each other. For example, during the rotation of the platen electrode 31*e*, a first voltage may be applied to the first split electrode that passes beneath the second polishing area PA2, and the first voltage may not be applied to the first split electrode that does not pass beneath the second polishing area PA2. In addition, during the rotation of the platen electrode 31*e*, a second voltage may be applied to the third split electrode that passes beneath the third polishing area PA3, and the second voltage may not be applied to the third split electrode that does not pass beneath the third polishing area PA3. For example, an electric field may be differently controlled only at the time of passing the polishing location PA. Therefore, slurry in the polishing location PA may be controlled differently from that in a remaining area. Accordingly, a substrate may improve in abrasion state. This procedure may be controlled in consideration of a rotation speed (rpm) of the platen 1*e*.

According to a substrate polishing apparatus, a substrate polishing system including the same, and a substrate polishing method using the same in accordance with some embodiments of inventive concepts, an electric field may be precisely controlled by diving a polishing location into a plurality of areas having different diameters. For example, behavior of slurry particles may be adjusted by independently controlling an electric field beneath an edge region of a substrate. Therefore, it may be possible to separately manage an abrasion state at the edge region of the substrate. Accordingly, the substrate may improve in abrasion performance.

Figure 16:
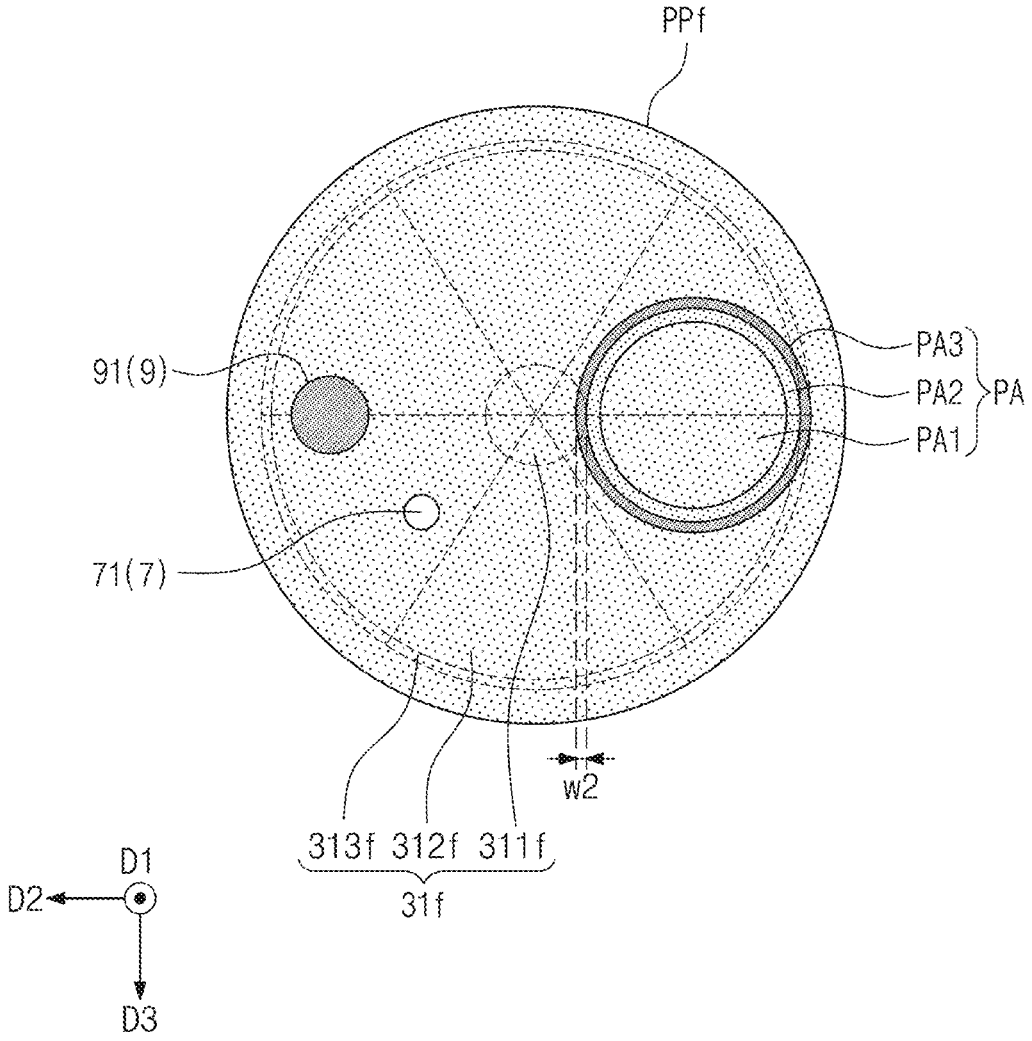
FIG. 16 illustrates a plan view showing a substrate polishing system according to some embodiments of inventive concepts.

FIG. 16 illustrates a plan view showing a substrate polishing system according to some embodiments of inventive concepts.

The following may omit explanation of components the same as or similar to those discussed with reference to FIGS. 1 to 15.

Referring to FIG. 16, a substrate polishing system may include a platen electrode 31*f*. The platen electrode 31*f* may be similar to the platen electrode 31*e* discussed with reference to FIG. 14. In contrast, there may be difference in radius of each of first, second, and third electrodes 311*f*, 312*f*, and 313*f* included in the platen electrode 31*f* of FIG. 16. For example, when viewed in plan, a region where the first electrode 311*f* overlaps the polishing location PA may be only the third polishing area PA3. In this case, when viewed in plan, the first electrode 311*f* may overlap neither the first polishing area PA1 nor the second polishing area PA2. When viewed in plan, a region where the third electrode 313*f* overlaps the polishing location PA may be only the second polishing area PA2 and the third polishing area PA3. In this case, when viewed in plan, the third electrode 313*f* may not overlap the first polishing area PA1. A second thickness w2 may be defined to indicate a maximum thickness in a radius direction of the region where the first electrode 311*f* overlaps the third polishing area PA3. The second thickness w2 may range from about 1 mm to about 8 mm. For example, the second thickness w2 may range from about 2 mm to about 6 mm.

According to a substrate polishing apparatus, a substrate polishing system including the same, and a substrate polishing method using the same in accordance with inventive concepts, it may be possible to separately control an electric field for each area.

According to a substrate polishing apparatus, a substrate polishing system including the same, and a substrate polishing method using the same in accordance with inventive concepts, it may be possible to separately control abrasion at an edge region of a substrate.

According to a substrate polishing apparatus, a substrate polishing system including the same, and a substrate polishing method using the same in accordance with inventive concepts, it may be possible to achieve a simple control of electric fields.

Effects of inventive concepts are not limited to the mentioned above, other effects which have not been mentioned above will be clearly understood to those skilled in the art from the following description.

Although some embodiments of inventive concepts have been described in connection with the accompanying drawings, it will be understood to those skilled in the art that various changes and modifications may be made without departing from the technical spirit and features of inventive concepts. It therefore will be understood that the embodiments described above are described for illustrative purposes and not for the purpose of limitation.

What is claimed is:

1. A substrate polishing apparatus, comprising:

an electric field applying module; and a platen configured to rotate a polishing pad, wherein the electric field applying module includes an inner electrode having a circular shape when viewed in plan, wherein the platen is on the inner electrode, wherein a central axis of the inner electrode is spaced apart from a central axis of the platen, wherein the inner electrode includes a first electrode and a second electrode, and wherein the second electrode surrounds the first electrode and has an annular shape.

2. The substrate polishing apparatus of claim 1, wherein a diameter of the inner electrode is in a range of about 250 mm to about 350 mm.

3. The substrate polishing apparatus of claim 1, wherein the inner electrode further includes a first dielectric layer between the first electrode and the second electrode.

4. The substrate polishing apparatus of claim 1, wherein the inner electrode further includes a third electrode that surrounds the second electrode and has an annular shape.

5. The substrate polishing apparatus of claim 1, wherein the electric field applying module further includes an outer electrode that surrounds the inner electrode, and wherein the outer electrode has a circular shape when viewed in plan.

6. The substrate polishing apparatus of claim 5, wherein a central axis of the outer electrode is coincident with the central axis of the platen, and a diameter of the outer electrode is in a range of about 700 mm to about 900 mm.

7. The substrate polishing apparatus of claim 1, wherein the electric field applying module further includes a voltage applying device that is configured to apply a voltage to the inner electrode, wherein the voltage applying device includes a first voltage applier configured to apply a first voltage to the first electrode and a second voltage applier configured to apply a second voltage to the second electrode.

8. The substrate polishing apparatus of claim 1, wherein the platen includes:

a platen body that provides an internal space;

a plurality of upper electrodes coupled to an upper portion of the platen body;

a plurality of lower electrodes coupled to a lower portion of the platen body and exposed toward a lower portion of the platen; and a plurality of connection members in the internal space and connecting corresponding lower electrodes to corresponding upper electrodes among the plurality of lower electrodes and the plurality of upper electrodes.

9. The substrate polishing apparatus of claim 8, further comprising:

a plurality of connection electrodes between the plurality of lower electrodes and the inner electrode, wherein the plurality of connection electrodes include a conductive textile material.

10. The substrate polishing apparatus of claim 1, wherein the first electrode includes a plurality of first split electrodes, the second electrode includes a plurality of second split electrodes, and the plurality of second split electrodes are arranged in a circumferential direction.

11. A substrate polishing system, comprising:

a platen;

a polishing pad on the platen;

a slurry supply apparatus configured to supply slurry to a top surface of the polishing pad;

a polishing head that supports a substrate; and a platen electrode coupled to the platen, wherein the platen electrode includes a first electrode and a second electrode, wherein the second electrode surrounds the first electrode and has an annular shape, and wherein each of the first electrode and the second electrode is divided into a plurality of electrodes that are split along a circumferential direction of the platen, wherein a central axis of at least one of the first electrode and the second electrode is spaced apart from a central axis of the platen.

12. The substrate polishing system of claim 11, wherein the substrate supported is in contact with the polishing pad on a polishing location in the polishing pad, and when viewed in plan, a region where the second electrode overlaps the polishing location has a maximum thickness in a radial direction of about 1 mm to about 8 mm.

13. The substrate polishing system of claim 11, wherein the substrate is in contact with the polishing pad on a polishing location in the polishing pad, and when viewed in plan, a region where the first electrode overlaps the polishing location has a maximum thickness in a radial direction of about 1 mm to about 8 mm.

14. The substrate polishing system of claim 11, wherein the platen electrode is on the platen and in contact with the polishing pad.

15. The substrate polishing system of claim 11, further comprising:

an electric field applying apparatus including a voltage applying device that is configured to apply a voltage to the platen electrode, wherein the voltage applying device includes a first voltage applier configured to apply a first voltage to the first electrode and a second voltage applier configured to apply a second voltage to the second electrode.

16. A substrate polishing method, comprising:

using a polishing head to place a substrate on a platen;

causing the substrate to contact a polishing pad, the polishing pad being configured to rotate;

supplying slurry onto the polishing pad; and generating an electric field on the polishing pad, wherein generating the electric field on the polishing pad includes generating an electric field on a polishing location with which the substrate is in contact, the polishing location being a portion of a top surface of the polishing pad, wherein the polishing location includes a first polishing area and a second polishing area that surrounds the first polishing area, and wherein the generating the electric field on the polishing location includes applying a first voltage to a first electrode and a second voltage to a second electrode, the first electrode is beneath the first polishing area, the second electrode is beneath the second polishing area, and the second voltage is different from the first voltage, wherein a central axis of at least one of the first electrode or the second electrode is spaced apart from a central axis of the platen.

17. The substrate polishing method of claim 16, wherein the generating the electric field on the polishing pad further includes generating an electric field on a remaining area of a top surface of the polishing pad, and the remaining area of the polishing pad is a portion of the top surface of the polishing pad other than the polishing location.

18. The substrate polishing method of claim 16, wherein each of the first electrode and the second electrode is beneath the platen.

19. The substrate polishing method of claim 18, wherein the causing the substrate to contact the polishing pad includes:

causing the substrate to perform a translational motion on the polishing pad; and causing each of the first electrode and the second electrode to perform translational motions, respectively.

20. The substrate polishing method of claim 16, wherein each of the first electrode and the second electrode are coupled to the platen and configured to rotate together with the polishing pad, the first electrode is divided into a plurality of first split electrodes along a circumferential direction of the platen, the second electrode is divided into a plurality of second split electrodes along the circumferential direction of the platen, the applying the first voltage to the first electrode includes applying the first voltage to a corresponding first split electrode that passes beneath the first polishing area, the corresponding first split electrode being selected from the plurality of first split electrodes, and the applying the second voltage to the second electrode includes applying the second voltage to a corresponding second split electrode that passes beneath the second polishing area, the corresponding second split electrode being selected from the plurality of second split electrodes.

* * * * *